US005316177A

United States Patent [19]

Boldt

[11] Patent Number: 5,316,177

[45] Date of Patent: May 31, 1994

[54] FACIAL TISSUE DISPENSING CARTON

[75] Inventor: Hans G. K. Boldt, Lahnstein, Fed. Rep. of Germany

[73] Assignee: Kimberly-Clark Corporation, Neenah, Wis.

[21] Appl. No.: 61,190

[22] Filed: May 12, 1993

Related U.S. Application Data

[63] Continuation of Ser. No. 906,725, Jun. 30, 1992, abandoned.

[51] Int. Cl.[5] ..... B65H 1/00

[52] U.S. Cl. ..... 221/63; 206/233

[58] Field of Search ..... 221/33, 63, 47, 48, 221/307, 303, 305; 206/233

[56] References Cited

U.S. PATENT DOCUMENTS

| | | | |
|---|---|---|---|
| 2,145,181 | 1/1939 | Kennedy | 221/305 |
| 2,953,293 | 9/1960 | Anderson | 221/302 X |
| 3,083,866 | 4/1963 | Strange | 221/302 X |
| 3,325,003 | 6/1967 | Bilezerian | 221/48 X |
| 4,574,952 | 3/1986 | Masui | 221/48 X |

FOREIGN PATENT DOCUMENTS

| | | | |
|---|---|---|---|
| 9108036 | 8/1991 | Fed. Rep. of Germany | B65D 83/08 |

*Primary Examiner*—David H. Bollinger
*Attorney, Agent, or Firm*—Gregory E. Croft

[57] ABSTRACT

Pop-up facial tissue dispensing cartons are provided with a paper dispensing window to replace the typical poly window for environmental reasons. The paper dispensing window is provided with an elongated opening having 2 or more slits emanating from each of its two ends which provide a means for holding the tissues in a pop-up position. Preferably the paper dispensing window is a coated paper having a reduced-friction coating which reduces noise during tissue removal.

10 Claims, 2 Drawing Sheets

FACIAL TISSUE DISPENSING CARTON

This is a continuation of Ser. No. 07/906,725, filed Jun. 30, 1992, now abandoned.

BACKGROUND OF THE INVENTION

Facial tissue cartons are available in a wide variety of designs. A popular design is one known as the "pop-up" carton, in which the user removes a tissue through a restricted opening in the top of the carton such that the next tissue partially comes along with it and is held so that it may be readily grasped by the user when another tissue is needed. The means commonly used for holding the next tissue in a ready position is a slit plastic film through which the tissues ate dispensed and which gently pinches the next tissue between the two sides of the slit. Such plastic films were particularly effective in eliminating "tissue fallback", which occurs when the next in line tissue is not held in a partially exposed condition and falls back into the carton. This is inconvenient for the user, who must reach through the dispensing opening into the carton to grasp the tissue. While such slit plastic films have, performed well, there is a need to replace plastic films with other means due to an increasing general environmental desire to replace plastics with degradable or otherwise more "environmentally friendly" materials.

SUMMARY OF THE INVENTION

It has now been discovered that certain coated paper materials, especially those provided with a multiplicity of properly arranged slits, can be used to provide tissue dispensing cartons with a pop-up window which approaches or equals the performance of slit plastic films with respect to "fallback" and ease of dispensing.

Hence, the invention resides in a tissue dispensing carton in which the tissues are withdrawn from the carton through an opening in a paper dispensing window, said opening having at least two slits emanating from each of its distal ends.

The paper window can be made of any paper having suitable strength and flexibility for the intended purpose. It is preferred that the paper have at least one smooth or glossy side which reduces the friction between the tissues and the paper, which helps to reduce the scratchy noise which can occur with uncoated papers. A suitable coated paper is a machine coated paper having a basis weight of about 80 grams per square meter. Both sides of the paper are coated with a coating having about 80 weight percent Cornwall China Clay with the balance being a styrene/butadiene polymer. The basis weight of the coating is about 25–35 grams per square meter (total weight for both sides of the paper). The coating provides a smoother and glossier surface to the base paper of the paper window and thereby reduces the noise associated with removing the tissues from the box through the opening. Such a paper is produced by KNP in the Netherlands.

DETAILED DESCRIPTION OF THE DRAWING

Figure 1:
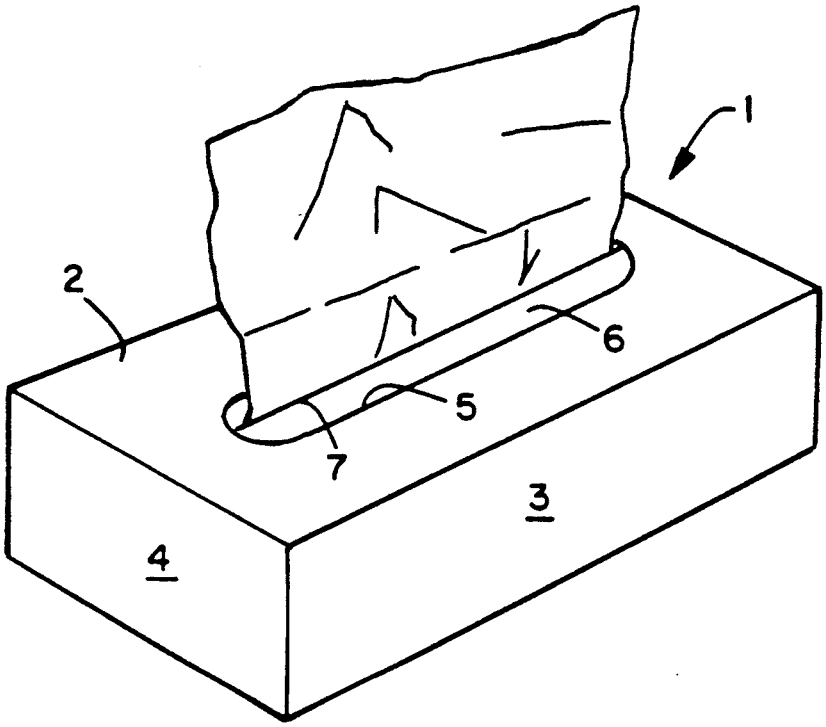
FIG. 1 (PRIOR ART)
FIG. 1 is a perspective view of a prior art pop-up tissue carton, illustrating a slit plastic film dispensing window.

Referring to Drawing, the invention will be described in greater detail. FIG. 1 is a perspective view of a prior art facial tissue dispensing carton having a plastic film dispensing window which is provided with a slit to pinch and hold the next available tissue in an upright position. Shown is the carton 1 having a top wall 2, sidewalls 3 and 4, an oval carton opening 5 in the top wall, a rectangular plastic dispensing window 6 (the edges of which are adhered to the inside surface of the top wall), and the slit 7. In some cartons, the slit may be replaced by an elongated opening.

Figure 2:
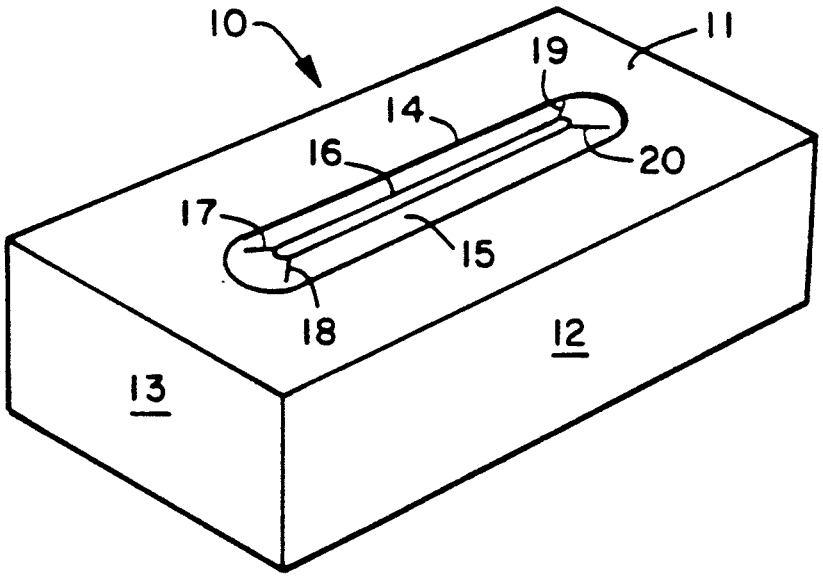
FIG. 2 is a perspective view of a tissue carton of this invention, illustrating a paper dispensing window having an elongated opening with two slits at each distal end of the opening.

FIG. 2 is a perspective view of a carton of this invention. Shown is the carton 10 having a top 11, sidewalls 12 and 13, a carton opening 14, and a paper dispensing window 15. The paper dispensing window is glued or otherwise affixed to the inside surface of the top of the carton. The edges of the paper dispensing window are indicated by dashed lines. The carton opening can be any shape which is large enough to expose the paper dispensing window opening 16 and the slits (in this embodiment slits 17,18,19 and 20) which emanate from the distal ends of the paper dispensing window opening. The paper dispensing window opening 16 can be any opening large enough to pass a tissue. It is preferred that the paper window dispensing opening be an elongated opening, not a slit, about 10 centimeters long and about 1 centimeter wide. This size provides for easy removal of the tissues from the carton while still providing sufficient enclosure to protect the tissues within the carton and sufficient constriction of the edges of the tissue at the distal ends of the opening to cause the edges of the tissue to slip into the slits and be held thereby.

The slits emanating from the distal ends of the paper window dispensing opening preferably form an acute angle with the longitudinal axis of the paper window dispensing opening. Each slit is at least about 1 centimeter long, preferably from about 1 to about 3 centimeters long. A preferred slit length is about 2 centimeters (1.8 centimeters). The lengths of the slits can be the same or different. The number of slits at each end of the paper window dispensing opening can be two or more, preferably two, three or four. The slits function to provide means to grab onto the tissue sheets as they are withdrawn from the carton and thereby hold the next-in-line tissue in a pop-up position. It is necessary that the tissue stack within the carton be interfolded such that removal of the top tissue causes the next tissue below it to be partially removed as well. Such means for interfolding tissues for pop-up dispensing are well known in the art.

Figure 3:
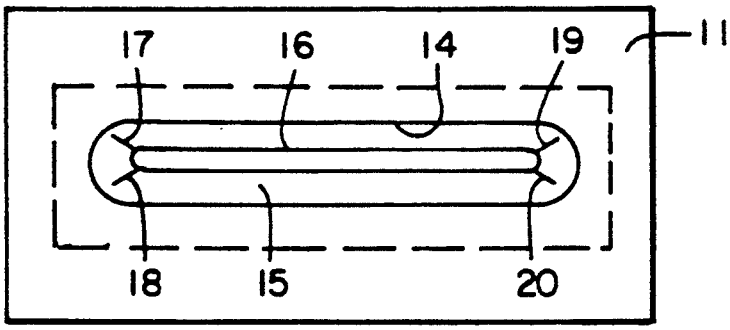
FIG. 3 is a top view of the tissue carton of FIG. 3.

FIG. 3 is a top or plan view of the tissue carton of FIG. 2, more clearly illustrating the carton opening and the paper dispensing window opening and the distal end slits.

Figure 4:
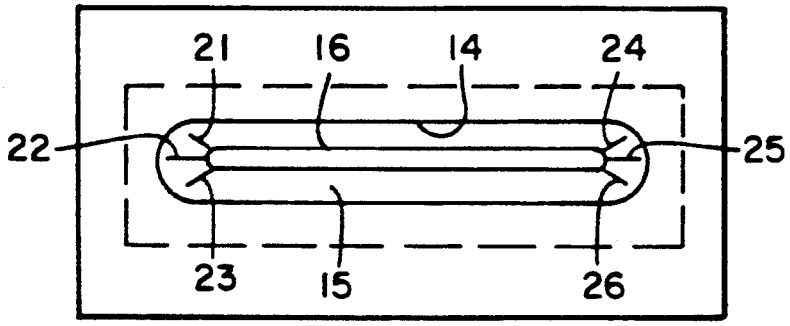
FIG. 4 is a top view of a tissue carton of this invention similar to that of FIGS. 2 and 3, but having three slits at each distal end of the opening.

FIG. 4 is a top view of a carton of this invention similar to the carton of FIG. 2, but having three slits at each distal end of the paper window dispensing opening. Shown are the same elements of the carton as shown in FIG. 3, as well as slits 21, 22, 23, 24, 25, and 26.

Figure 5:
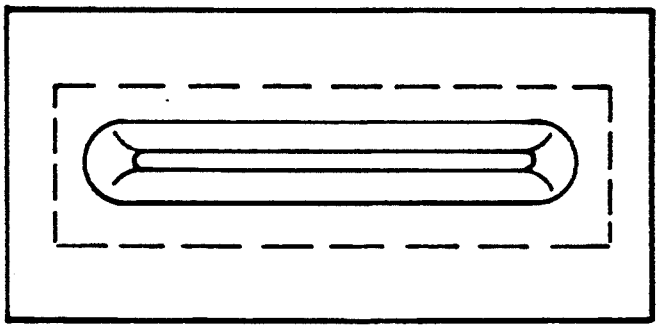
FIG. 5 is a top view of a tissue carton having an elongated opening the same as that of the carton of FIGS. 2 and 3, but having two curved slits near the distal ends of the opening.

FIG. 5 is a top view of a carton, not of this invention, having curved slits 31, 32 33, and 34 near each distal end of the paper window dispensing opening. Note that each slit does not originate or emanate from the distal ends of the opening, but instead emanates from the sides of the opening near the distal ends of the opening. It is advantageous for the slits to emanate from a portion of the opening that serves to funnel the edges of the tissue into the slits. In the case of the opening shapes tested and illustrated herein, the rounded distal ends of the otherwise parallel sides of the openings serve this function. It is also important that the slits emanate from the ends of the opening, as opposed to the sides or parallel edges of the opening, or else the edges of the tissues may not slide into the slits as the tissues are withdrawn from the box.

EXAMPLES

In order to illustrate the advantages of the invention, a number of facial tissue cartons were tested for fallback. Specifically, boxes or cartons of interfolded facial tissues containing 200 tissues and having different openings were compared for dispensing failures by manually removing all of the tissues within each box one at a time. "Complete failures" were defined as having no tissue protruding from the box. "Partial failures" were defined as having a tissue protruding from the box less than 2 centimeters. "Total failures" were defined as the sum of the Complete failures and the Partial failures. The various openings tested included the prior art "poly" window, which consisted of a thin plastic film with a single elongated slit as depicted in FIG. 1; a "plain" opening without a window material, which merely consisted of a perforated oval opening in the top of the box; a "paper window #1", which consisted of a paper window (60 grams per square meter (gsm) basis weight) with a single elongated slit as in the poly window; a "paper window #2", which consisted of a plain paper window (60 gsm) with a double-cut opening as depicted in FIGS. 2 and 3; "paper window #3", which consisted of a coated paper (70 gsm) with the same double-cut opening of paper window #2; "paper window #4", which consisted of a coated paper (70 gsm) with the triple-cut opening as depicted in FIG. 4; and "paper window #5", which consisted of a coated paper (70 gsm) with the curved double-cut opening as depicted in FIG. 5. A table summarizing the results of the dispensing testing is set forth below:

TABLE

| Box Size | Type of Opening | (Pop-Up Failure) Sample Size (Boxes) | Failures per Box Complete | Partial | Total |
|---|---|---|---|---|---|
| 200 | Poly | 10 | 0 | 0 | 0 |
| 200 | Plain | 5 | 7.8 | 4.6 | 12.4 |
| 200 | Paper Window #1 | 10 | 0.8 | 0.9 | 1.7 |
| 200 | Paper Window #2 | 8 | 0.6 | 0.1 | 0.7 |
| 200 | Paper Window #3 | 10 | 0.7 | 0.1 | 0.8 |
| 200 | Paper Window #4 | 8 | 0.1 | 0.3 | 0.4 |
| 200 | Paper Window #5 | 9 | 1.6 | 0.4 | 2.0 |

The results of the dispensing testing illustrate the effectiveness of the paper windows of this invention (Paper window Nos. 2, 3 and 4). As discussed earlier with respect to FIG. 5, Paper window #5 did not perform well because the slits did not emanate from the distal ends of the opening, but rather from the side edges of the opening. No significance is attributed to the fact that the slits were curved.

It will be appreciated that the foregoing examples, given for purposes of illustration, are not to be construed as limiting the scope of this invention, which is intended to be defined by the scope of the following claims and all equivalents thereto.

I claim:

1. A pop-up tissue dispensing carton having a top wall with a carton opening therein, said carton opening being covered with a paper dispensing window affixed to the inside of the top wall and having an elongated opening through which tissues within the carton are withdrawn, said elongated opening having at least two slits emanating from its distal ends at an acute angle relative to the longitudinal axis of the elongated opening and which lightly pinch and hold the tissues to prevent fallback.

2. The carton of claim 1 wherein there are two slits at each distal end of the elongated opening.

3. The carton of claim 1 wherein there are three slits at each distal end of the elongated opening.

4. The carton of claim 1, 2, or 3 wherein the paper dispensing window is a coated paper.

5. The carton of claim 1 wherein the length of the slits is from about 1 to about 3 centimeters.

6. The carton of claim 5 wherein the length of the slits is about 2 centimeters.

7. A pop-up tissue dispensing carton having a top wall with a carton opening therein, said carton opening being covered with a coated paper dispensing window affixed to the top wall and having an elongated opening through which tissues within the carton are withdrawn, said elongated opening having at least two slits emanating from its distal ends at an acute angle relative to the longitudinal axis of the elongated opening and which lightly pinch and hold the tissue to prevent fallback, said slits having a length of from about 1 to about 3 centimeters.

8. The carton of claim 7 having two slits at each distal end of the elongated opening.

9. The carton of claim 7 having three slits at each distal end of the elongated opening.

10. The carton of claim 8 or 9 wherein the length of the slits is about 2 centimeters.

* * * * *